US009187208B2

(12) United States Patent
Masci

(10) Patent No.: US 9,187,208 B2
(45) Date of Patent: Nov. 17, 2015

(54) JOINT BUILDING SYSTEM FOR BOX STRUCTURES

(76) Inventor: Giuseppe Masci, Rome (IT)

( * ) Notice: Subject to any disclaimer, the term of this patent is extended or adjusted under 35 U.S.C. 154(b) by 0 days.

(21) Appl. No.: 13/496,443

(22) PCT Filed: Sep. 15, 2009

(86) PCT No.: PCT/IT2009/000410
§ 371 (c)(1),
(2), (4) Date: Mar. 15, 2012

(87) PCT Pub. No.: WO2011/033534
PCT Pub. Date: Mar. 24, 2011

(65) Prior Publication Data
US 2012/0175377 A1 Jul. 12, 2012

(51) Int. Cl.

| | |
|---|---|
| ***B65D 6/16*** | (2006.01) |
| ***B65D 88/52*** | (2006.01) |
| ***B65D 6/00*** | (2006.01) |
| ***B65D 6/24*** | (2006.01) |
| ***B65D 13/02*** | (2006.01) |

(52) U.S. Cl.
CPC .. *B65D 7/24* (2013.01); *B65D 9/12* (2013.01); *B65D 9/32* (2013.01); *B65D 11/1873* (2013.01); *B65D 13/02* (2013.01); *B65D 88/528* (2013.01); *Y10T 29/49826* (2015.01)

(58) Field of Classification Search
CPC ..... B65D 7/24; B65D 13/02; B65D 11/1873; B65D 9/32; B65D 9/12; B65D 88/528
USPC ..... 446/105, 127; 217/12 R, 43 R
See application file for complete search history.

(56) References Cited

U.S. PATENT DOCUMENTS

| | | | | | |
|---|---|---|---|---|---|
| 756,338 | A | * | 4/1904 | Doten | 217/12 R |
| 1,209,027 | A | * | 12/1916 | Quade | 217/12 R |
| 3,261,492 | A | * | 7/1966 | Johnson | 217/12 R |
| 3,410,441 | A | * | 11/1968 | Rhyne | 220/4.28 |
| 3,700,134 | A | * | 10/1972 | Blanchard | 217/12 R |
| 3,713,718 | A | * | 1/1973 | Lucci | 312/263 |
| 3,902,637 | A | * | 9/1975 | Scheeler | 222/144.5 |

(Continued)

FOREIGN PATENT DOCUMENTS

| | | | | | |
|---|---|---|---|---|---|
| GB | 969578 | A | * | 9/1964 | |
| JP | 2005102800 | A | * | 4/2005 | B44C 3/00 |

OTHER PUBLICATIONS

English translation of JP2005102800 abstract taken from Espacenet.com.*

*Primary Examiner* — Anthony Stashick
*Assistant Examiner* — Mollie Llewellyn
(74) *Attorney, Agent, or Firm* — Holland & Hart LLP

(57) ABSTRACT

The present invention solves a problem of building geometry in a system to assemble and shut exclusively by jointing the six walls of a box parallelepiped built up with at least seven plates, so: • the plates are divided in a first group of six, named primary, each one provided with a couple of grooves, and in a second group of the remaining plates, named secondary, not necessarily grooved; • the walls of the structure are divided in two types: single walls, composed by only one primary plate: multiple walls, composed by one primary plate and at least one secondary plate; • the structure, which must have at least one multiple wall, is assembled and shut jointing together first the six primary plates and then introducing at least one of the secondary plates. The system is suitable to build countless artefacts.

8 Claims, 13 Drawing Sheets

(56) References Cited

U.S. PATENT DOCUMENTS

| | | | | | |
|---|---|---|---|---|---|
| 4,012,090 | A * | 3/1977 | Pfeifer et al. | ..... | 312/348.2 |
| 4,082,356 | A * | 4/1978 | Johnson | ..... | 297/440.13 |
| 4,262,605 | A * | 4/1981 | Sokol | ..... | 108/91 |
| 4,561,554 | A * | 12/1985 | Swincicki | ..... | 220/4.28 |
| 5,743,421 | A * | 4/1998 | Gonzalez et al. | ..... | 220/4.28 |
| 6,309,039 | B1 * | 10/2001 | Park et al. | ..... | 312/258 |
| 6,497,018 | B1 * | 12/2002 | Chiu et al. | ..... | 27/2 |
| 6,558,222 | B1 * | 5/2003 | Maddock | ..... | 446/105 |
| 8,622,489 | B2 * | 1/2014 | Crabtree, II | ..... | 312/263 |
| 2010/0093257 | A1 * | 4/2010 | Elliott | ..... | 446/478 |

* cited by examiner

Fig. 28
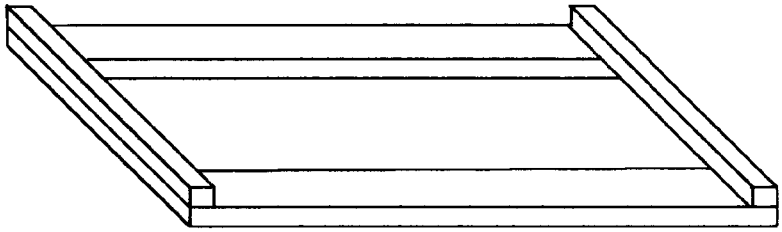
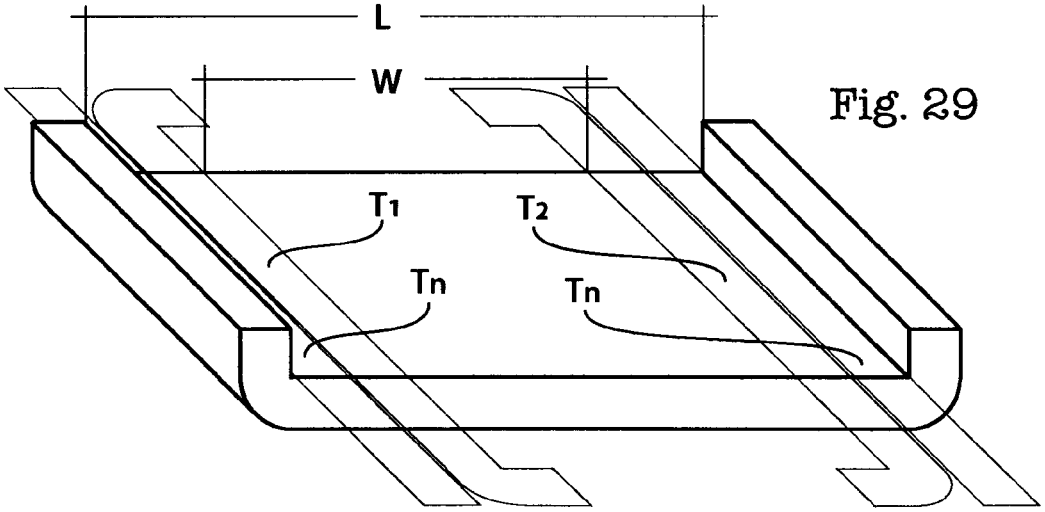
Fig. 29
Fig. 30
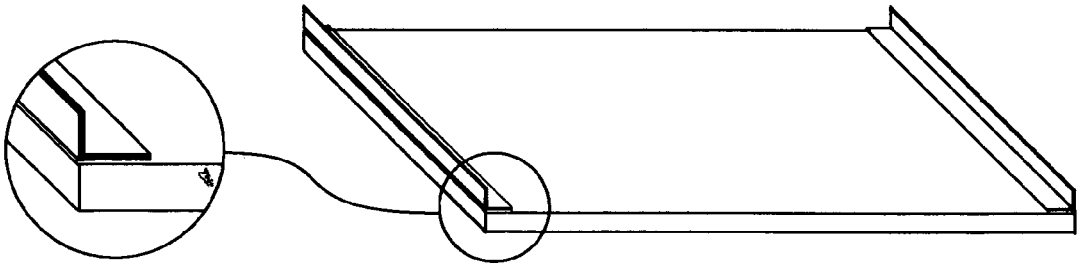

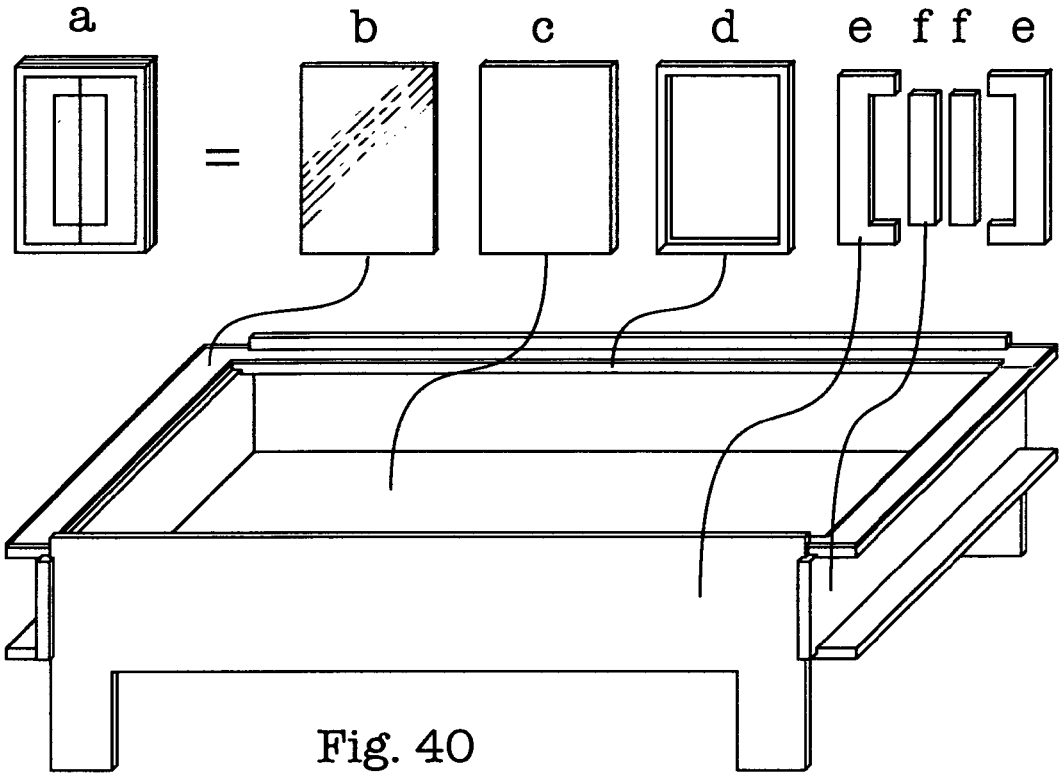
Fig. 40
Fig. 41
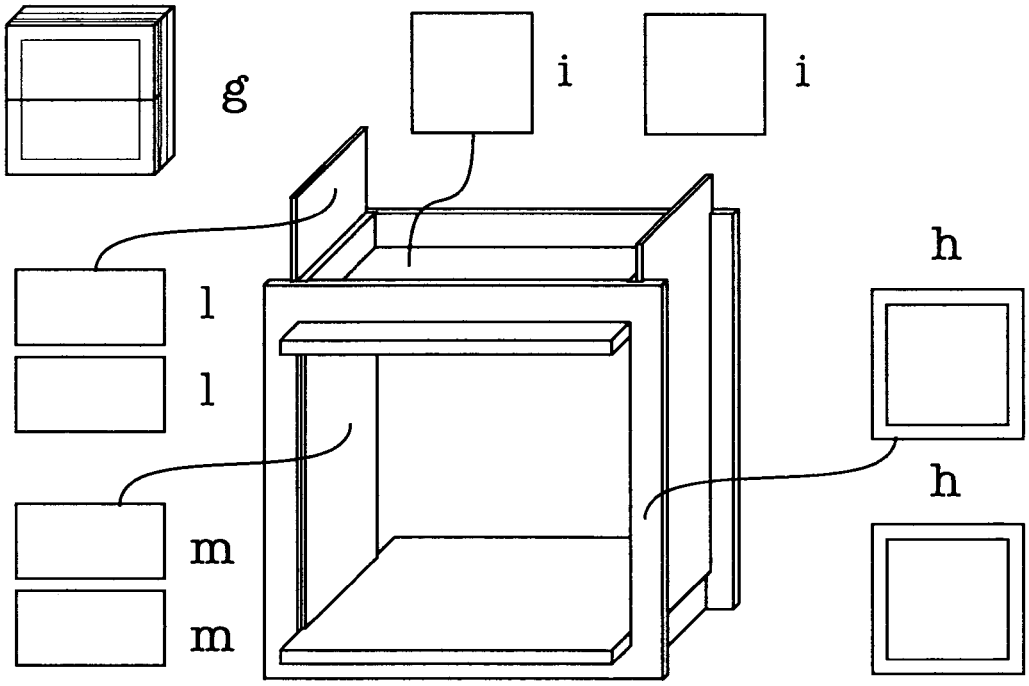

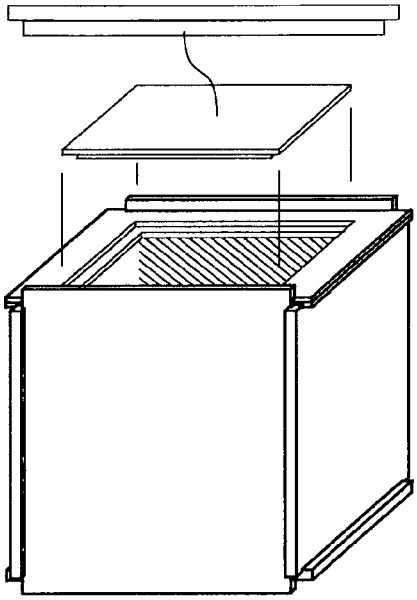
Fig. 43
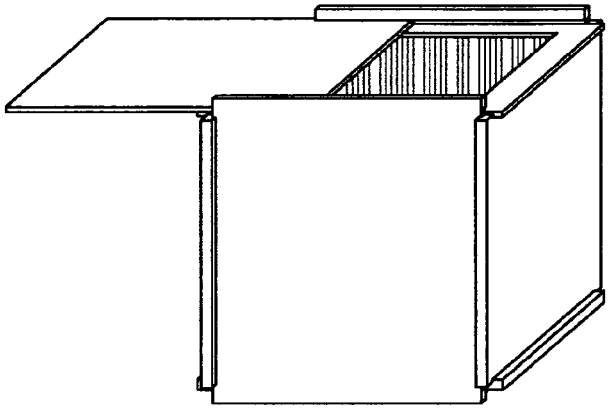
Fig. 42
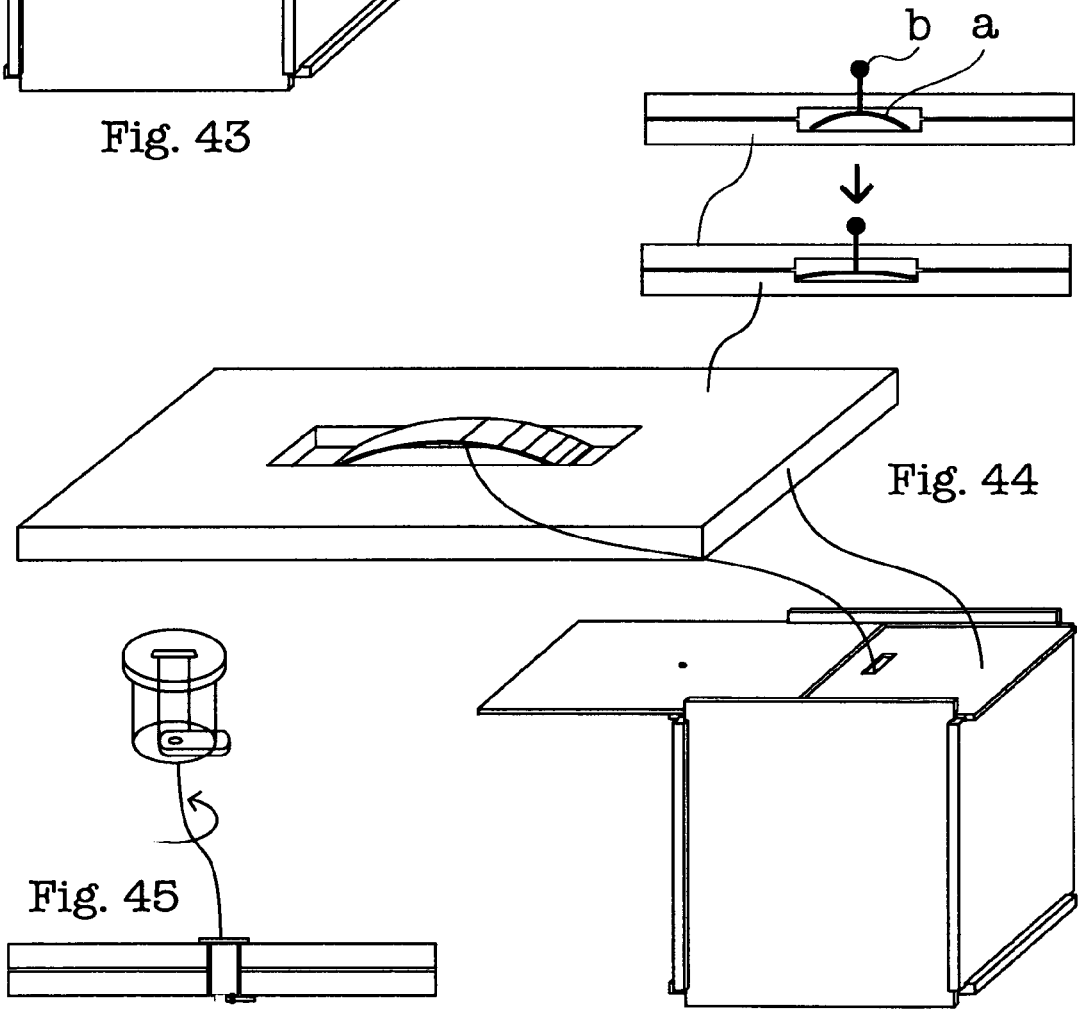
Fig. 44
Fig. 45

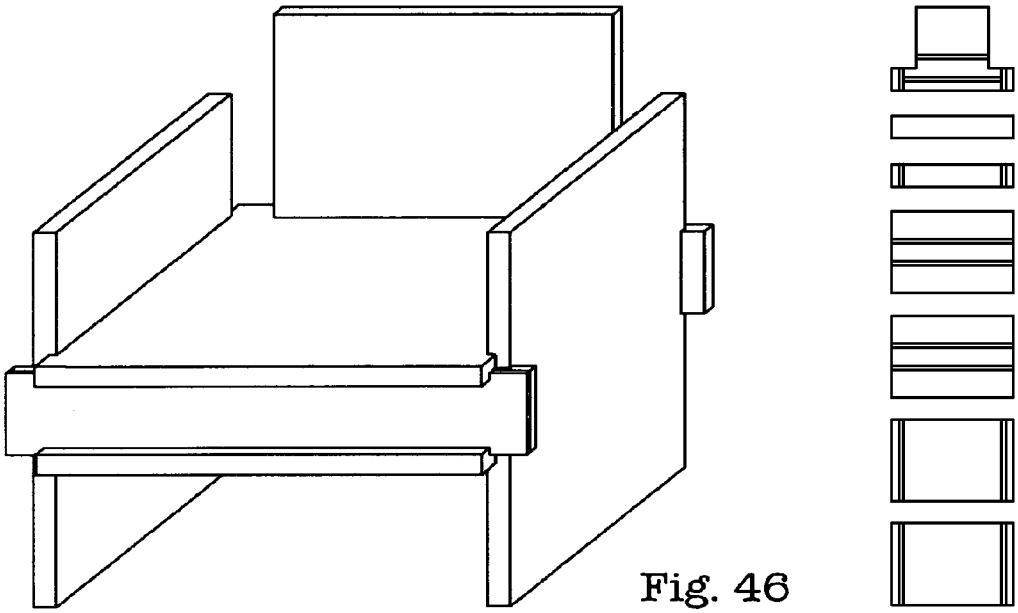
Fig. 46
Fig. 47
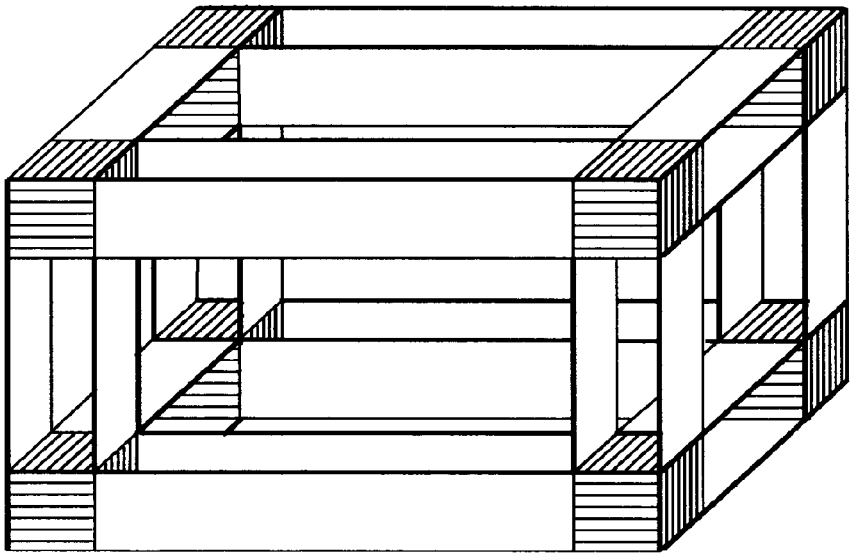

JOINT BUILDING SYSTEM FOR BOX STRUCTURES

TECHNICAL FIELD

The present invention can be placed in the field of the building geometry solutions applicable to a big number of industrial products.

It consists in a joint building system to assemble and to shut the six walls of a box parallelepiped at the minimal possible condition to split at least one wall of the structure in at least two plates.

From a practical point of view, the flexibility of the building system allows to create countless artefacts, also complex, which in the most of the cases are built up with only seven elements simply jointed together.

This system allows to joint together several structures, then it can be considered also a nodal joint for building complex structures.

Finally a particular characteristic of the invention, allowing to assemble twelve plates all perfectly identical in a cube, could pertain to other fields of belonging.

BACKGROUND ART

The background art of the present invention concerns mainly in the solution of the building geometry problem above mentioned.

We cannot refer to any existent techniques about this aspect.

The background art concerns as well the set of elements and of technical characteristics that exist separately in other joint systems, even complex.

Also in this case it is difficult to give any information about building systems like that in object for the variety of its configurations and its applications.

DISCLOSURE OF INVENTION

According to the first aspect, the present invention consists in a joint building system that allows to assemble and shut firmly, without any other brackets, box structures, including:

- at least seven plates of sheet stiff material, characterised by:
- the plates are divided in a first group of six, named primary, each one provided with a couple of grooves, and in a second group of the remaining plates, named secondary, not necessarily grooved;
- the walls of the structure are divided in two types: single walls, composed by only one primary plate; multiple walls, composed by one primary plate and at least one secondary plate;
- the structure, which must have at least one multiple wall, is assembled and shut jointing together first the six primary plates and then introducing at least one of the secondary plates.

The terms "primary" and "secondary" recall the order in which the plates must be assembled.

Examples of box structures are shown in FIG. 1-2-3-4-5.

Examples of multiple walls are shown in FIG. 6-7.

Examples of primary and secondary plates are shown in FIG. 8-9.

According to another aspect, the present invention consists in a joint building system, including at least seven plates, characterised by:

- the plates can be made of any stiff material such as wood, plywood, glass, stone, metal, plastic, and used also in mixed types;
- the plates can be strengthened with stiffening ribs and/or by folding materials, FIG. 10 (*b*);
- the plates can have predetermined free dimensions, thickness included, FIG. 11-12;
- the plates can also be modelled internally and/or externally to their perimeter, FIG. 13, frame shape included, FIG. 14;
- the plates can also be prefabricated, then composed by previously assembled elements, even if simply jointed, FIG. 16-17.

According to another aspect, the present invention consists in a joint building system, including at least seven plates, characterised by:

- each one of the six primary plates has a couple of grooves, in a way that they can be jointed together, with ribs of the ungrooved sides of each one in the grooves of other ones, FIG. 8.
- the primary plates can be modelled, provided that some segments of the grooved sides and of the ungrooved side ribs are preserved, sufficiently to joint firmly the elements of the structure, FIG. 13.
- the primary plates can be extended also in the orthogonal direction to the grooves, FIG. 15.

According to another aspect, the present invention consists in a joint building system, including at least seven plates, characterised by:

- in order to block the structure, at least one secondary plate must be inserted in remaining space of the grooves, receiving it, which have been suitably sized for this purpose, FIG. 35;
- the secondary plates can take all the same possible shapes of the primary plates, grooved shapes included;
- the secondary plate can have a complementary thickness with its coupled primary plate, so their total thickness is equal to the other walls one, FIG. 18 (*a,b*);
- the secondary plate can have a supplementary thickness with its coupled primary plate, so their total thickness is bigger than the other walls one, FIG. 18 (*c,d*).

The preferred embodiment of the present invention provides for one or more elements named secondary plates.

This should not be seen as a limitation, indeed it does not produce any change in the framework of the present invention, so that:

- the secondary plate can be replaced by any device carrying out an identical role, FIG. 19-20-21.

According to another aspect, the present invention consists in a joint building system, including at least seven plates, characterised by:

- the grooves, arranged for jointing, are situated—in parallel rectilinear couples—at the edges of two opposite sides of each one of the six primary plates, FIG. 8.
- the grooves can be also discontinuous and/or in minimum quantity, FIG. 10 (*a*);
- the width of grooves is equal to the thickness of the single or multiple wall received, FIG. 22-23;
- the depth (D) of grooves is minor or equal to the thickness (T) of the secondary plate or plates received, FIG. 24;
- for grooves must be intended also any device, applied to the plates, that can carry out the same roles, FIG. 25.

In the formulation of the present invention, the characteristic of the primary plates is represented by the grooves.

This should not be seen as a limitation, because the framework of the system in object, is still unchanged in the following aspect.

According to another aspect, the present invention consists in a joint building system, including at least seven plates, characterised by:

- each one of the six primary plates is provided with a couple of folds (in this case the attribute of the joint is with one-sided containment), FIG. 26-27-28, so they can be jointed together, with ribs of the unfolded side of each one inside the folds of the other one;
- the primary plates can be modelled, provided that some segments of the folded sides and of the unfolded side ribs are preserved, sufficiently to joint firmly the elements of the structure;
- the folds are situated, in parallel couples, at the edges of two opposing sides of each one of the six primary plates;
- the folds are rectilinear, arranged for jointing, even if they are in discontinuous and/or in minimum quantity;
- the depth of folds is minor or equal to the thickness of the secondary plate or plates received;
- the internal length (L) of a primary plate, from fold to fold, is equal to the Width (W) of the hosting wall, plus the thickness ($T_1$, $T_2$ . . . $T_n$) of the plates received, FIG. 29.
- for fold must be intended also any device, applied to the plates, that can carry out the same roles, FIG. 30.
- in order to block the structure, at least one secondary plate must be inserted in the remaining free space amid the primary plate and the folds, receiving it, and that are properly sized for this purpose.

According to another aspect, the present invention consists in a joint building system, including at least seven plates, characterised by:

- the procedure to assemble a minimal box structure built up with seven plates is carried out through the following steps shown in FIGS. 31 to 36:

The couples of the opposed primary plates are marked by $A_1$-$A_2$, $B_1$-$B_2$, $C_1$-$C_2$ and the secondary plate is marked by D;

- $C_1$ is jointed in $A_1$ and $A_2$, FIG. 31-32;
- $B_1$ and $B_2$ are jointed, movement (1), on $A_1$ and $A_2$ and then they are pushed downward, movement (2), in $C_1$, FIG. 33;
- $C_2$ is inserted, movement (1), in the grooves of $A_1$ and $A_2$ and then it is pushed downward, movement (2), in $B_1$ and $B_2$, FIG. 34;
- D is inserted in the grooves of $A_1$ and $A_2$, sliding on $C_2$, FIG. 35-36.

The most significant advantages of the present invention are:

- The system in object allows to make countless artefacts.
- The built up artefacts are held firmed.
- The field of applications is wide and various.
- The employed materials are various and in mixed type.
- The work processing requested is very short.
- The employed machines and labour are minimum.
- The cost of production is extremely reduced.
- The dimensions of packing and storage. are reduced.
- The assembling-disassembling of the artefacts is simple and quick.
- The rejected items are considerably reduced.

BRIEF DESCRIPTION OF DRAWINGS

FIG. 28: Prefabricated frame plate in a folded shape.

FIG. 29: Inner length (L)=($W+T_1+T_2+T_n$) of a folded primary plate.

FIG. 30: Example of a substitutive device of the fold.

FIG. 40: A small table built up with plates (d,e,f), obtained by cutting them, one into the other, from the same sheet, that is equal both to the plate (c) and to the glass secondary plate (b).

FIG. 41: A library module built up with plates jointed both with the internal and the external ribs, using two secondary plates, in which disassembled and stacked plates (h,i,l,m), make a parallelepiped (g).

FIG. 42: A box with an access hole on a primary plate and with a secondary plate working as a sliding lid.

FIG. 43: A box with one holed multiple wall and with a blocking lid obtained by rejected items from the holing of two plates of multiple wall.

FIG. 44: An example of fixing device: fly spring (a) that allows the (secret) opening of the box through a pin (b).

FIG. 45: An example of fixing device: a classic padlock.

FIG. 46: An armchair built up extending the walls of the structure.

FIG. 47: A complex structure composed by several structures joined together by the extension of the primary plates.

BEST MODES FOR CARRYING OUT THE INVENTION

The generic minimal structure, built up with seven plates, is suitable for building many kinds of boxes and countless artefacts.

Among the possible configurations of the present invention the followings are the preferred.

Figure 1:
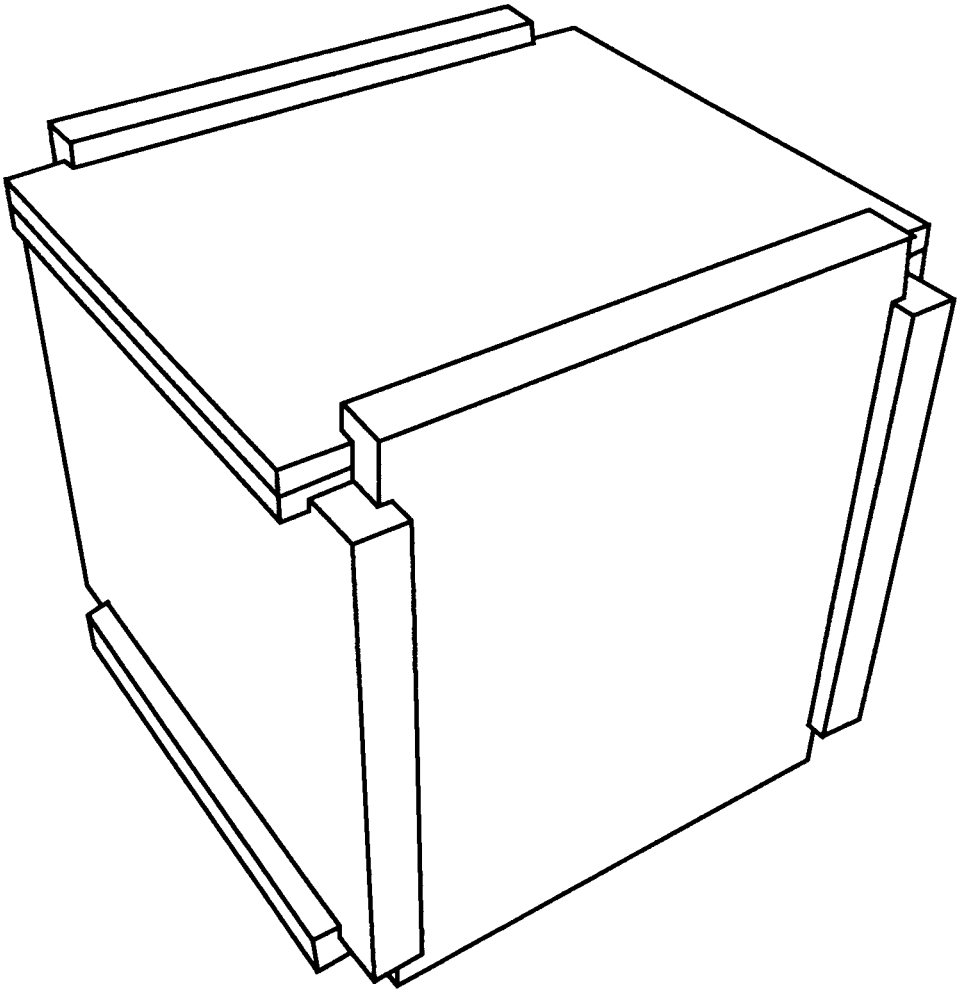
FIG. 1: Minimal cubic box structure with a multiple wall built up with one primary plate and one secondary plate.
Figure 2:
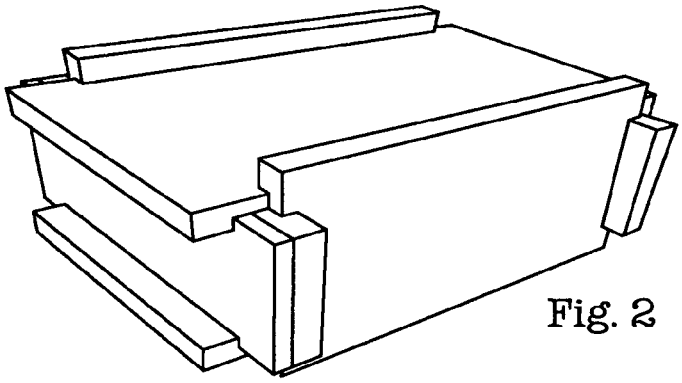
FIG. 2: Structure in a parallelepiped shape.
Figure 3:
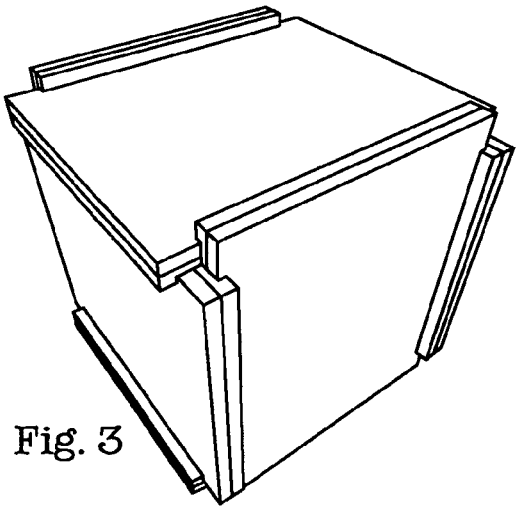
FIG. 3: Structure with six multiple walls.
Figure 4:
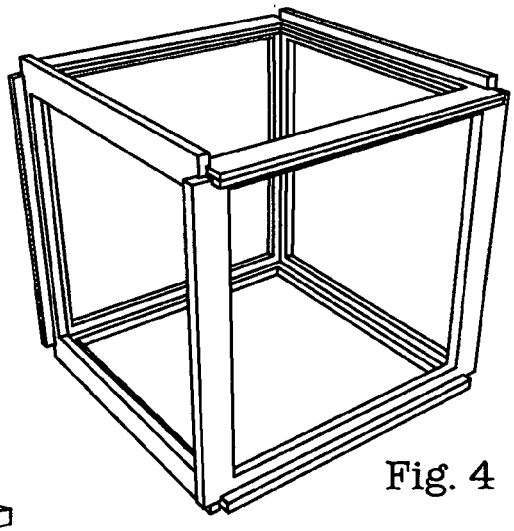
FIG. 4: Structure with walls in a frame shape.
Figure 5:
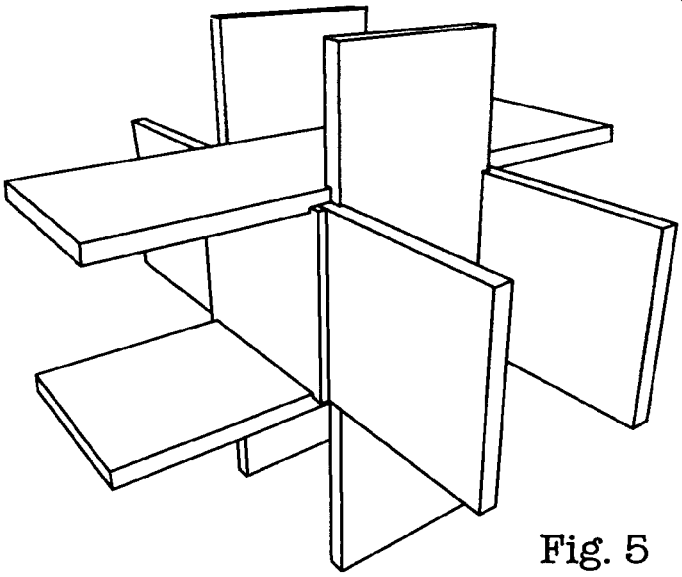
FIG. 5: Structure with extended walls.
Figure 6:
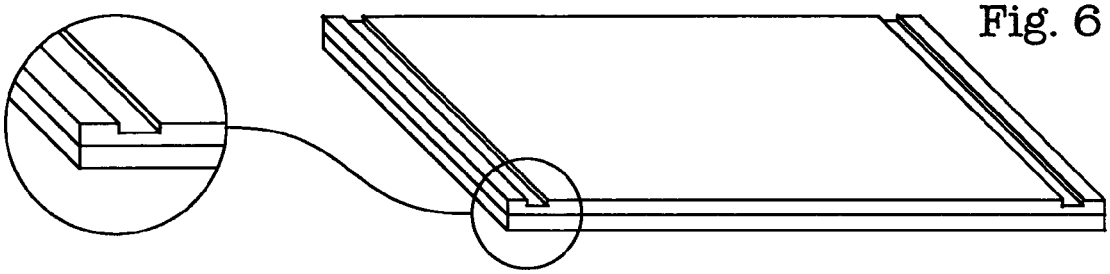
FIG. 6: Multiple wall built up with two plates.
Figure 7:
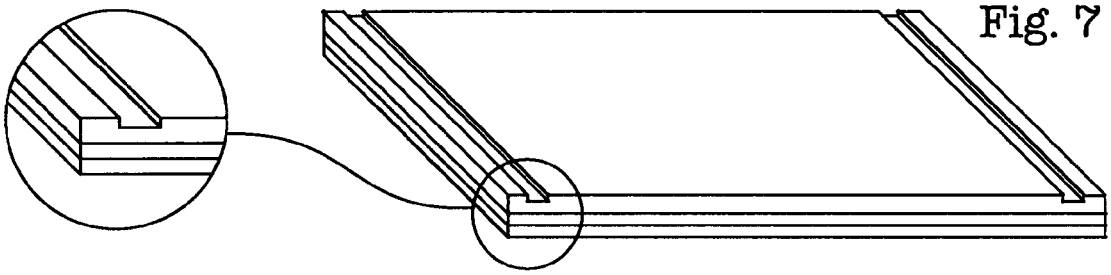
FIG. 7: Multiple wall built up with three plates.
Figure 8:
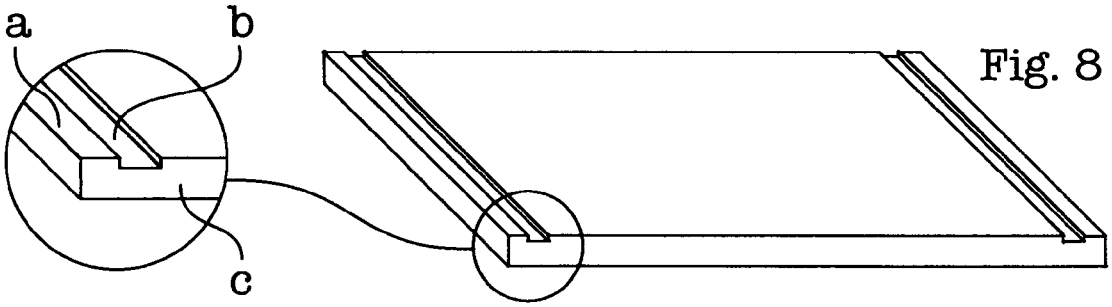
FIG. 8: Primary plate; pilaster strip (a), groove (b), rib (c).
Figure 9:
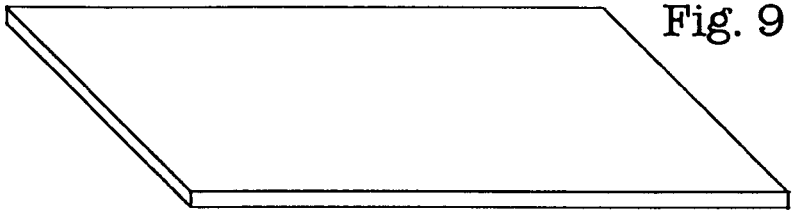
FIG. 9: Secondary plate in its simplest shape.
Figure 10:
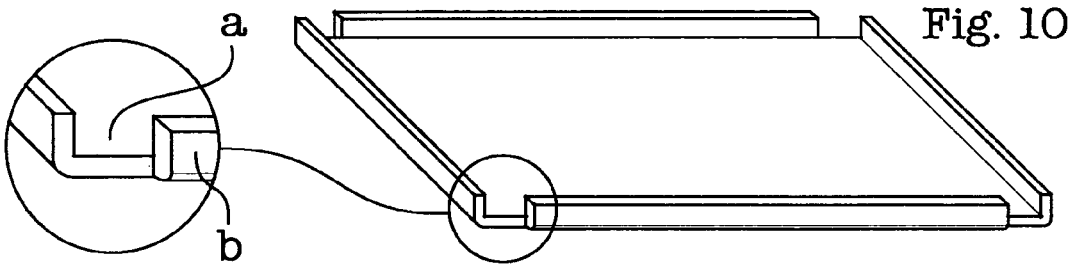
FIG. 10: Portion of groove (a); stiffening fold (b).
Figure 11:
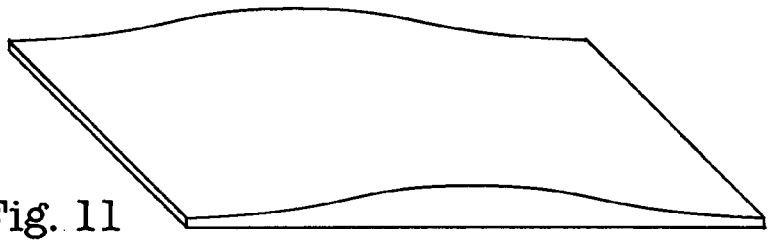
FIG. 11: Secondary plate modelled in its thickness.
Figure 12:
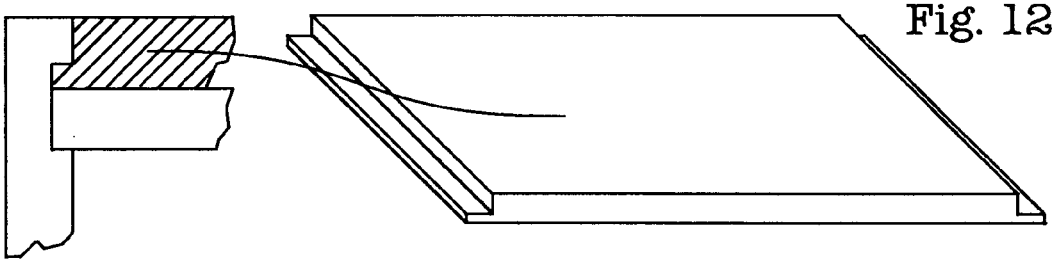
FIG. 12: Secondary plate with an incremented thickness to fill in the empty room in the protruding of the pilaster strips.
Figure 13:
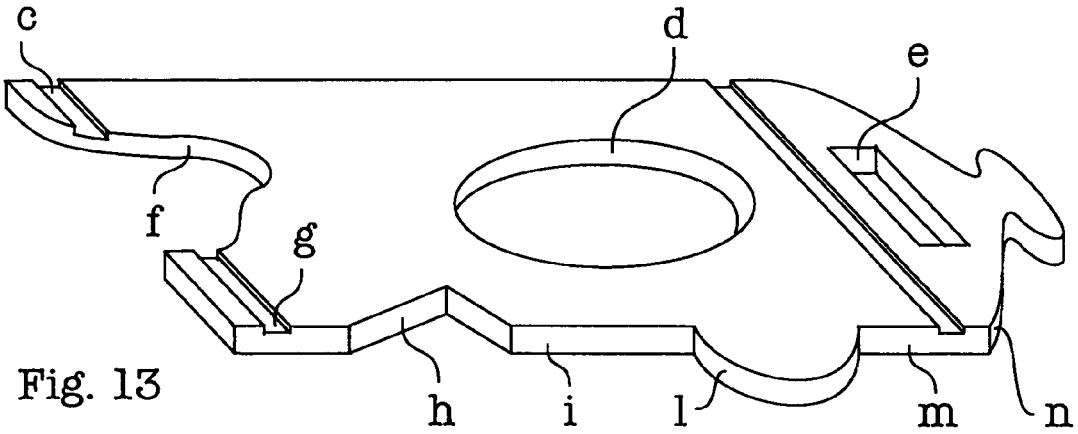
FIG. 13: Portions of grooves (c,g); internal (d,e) and external (f,h,l,n) modellings to the perimeter; portions of ribs (i,m).
Figure 14:
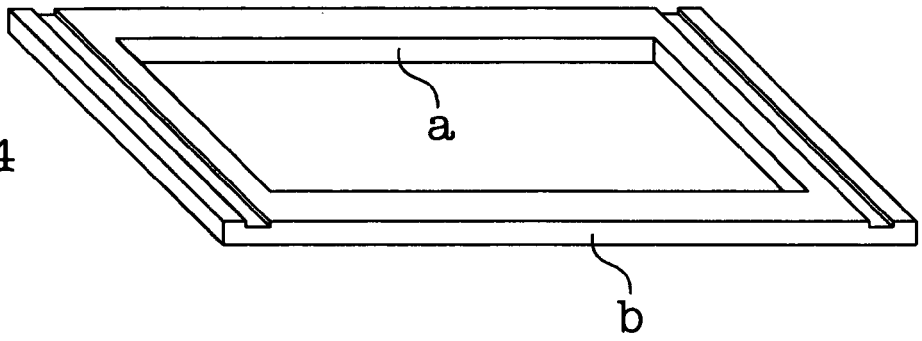
FIG. 14: Frame plate; internal (a) and external (b) ribs.
Figure 15:
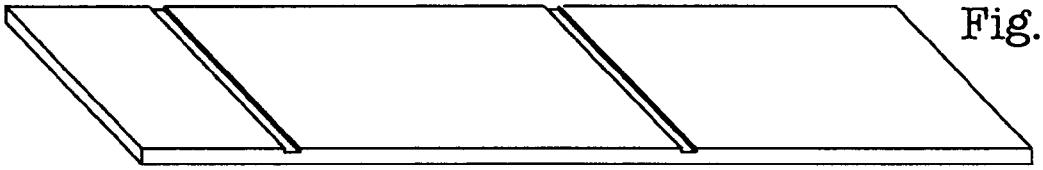
FIG. 15: Plate extended beyond the grooves.
Figure 16:
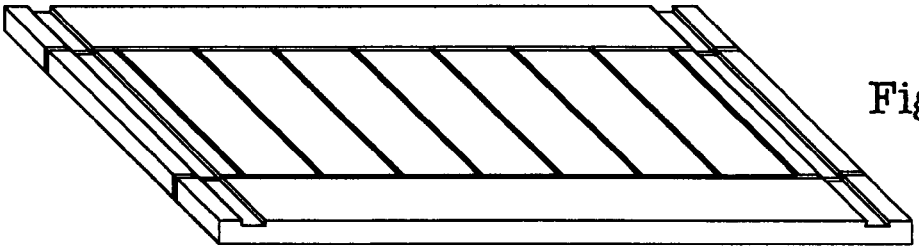
FIG. 16: Prefabricated plate.
Figure 17:
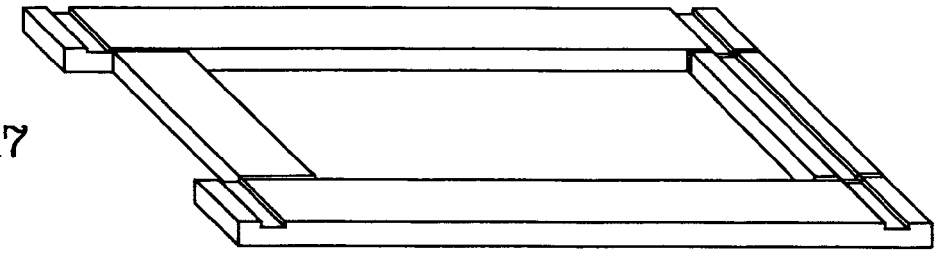
FIG. 17: Prefabricated plate in a frame shape.
Figure 18:
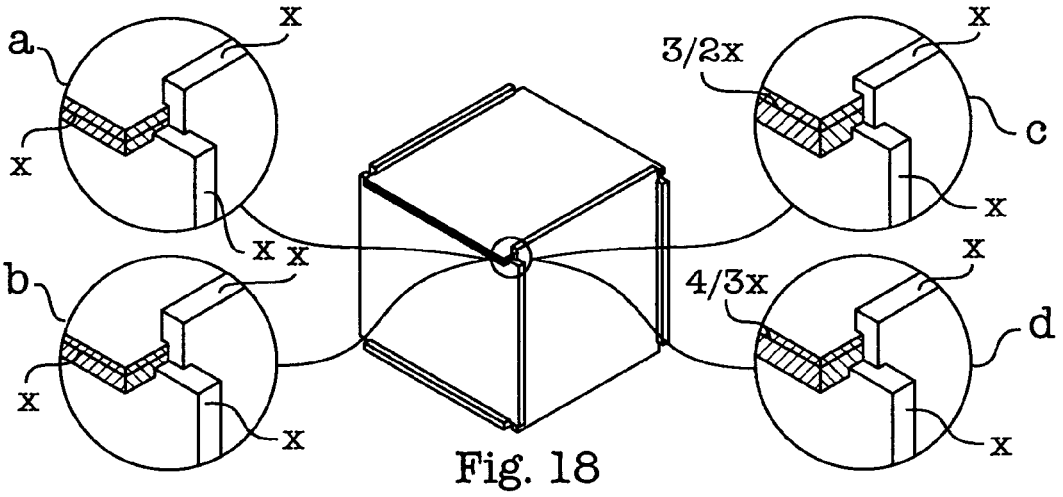
FIG. 18: Complementary plates (a,b), in which all walls have the same thickness; supplementary plates (c,d), in which the total thickness of the multiple wall is bigger than the other walls.
Figure 19:
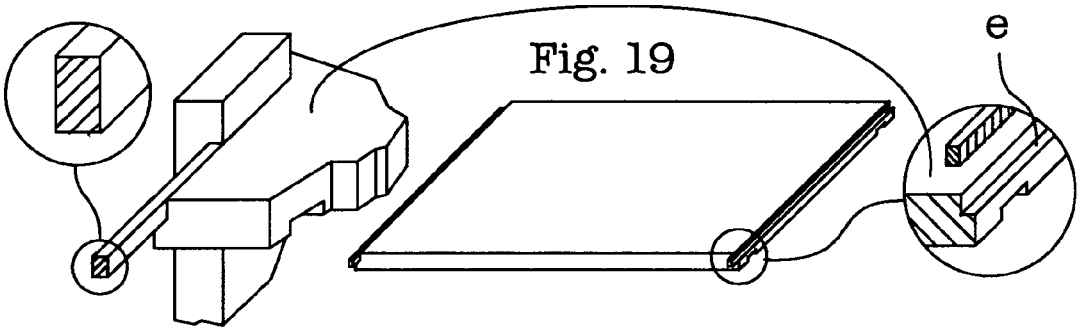
FIG. 19: Example of substitutive elements of the secondary plate and a modified primary plate (e).
Figure 20:
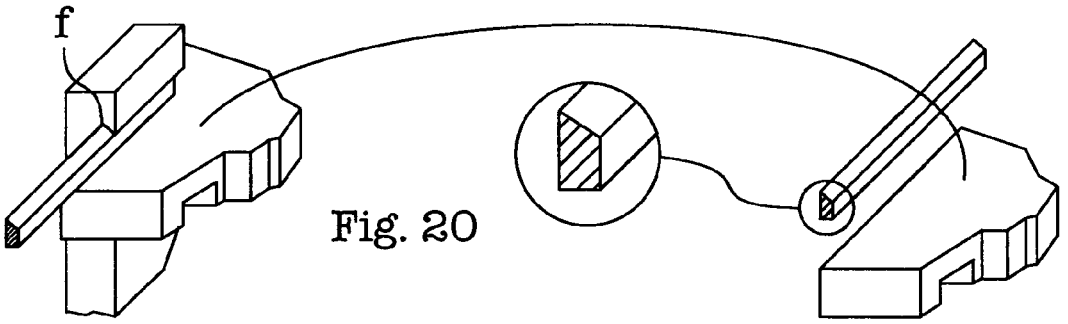
FIG. 20: Example of substitutive elements of the secondary plate, and a modified groove of the primary plate (f).
Figure 21:
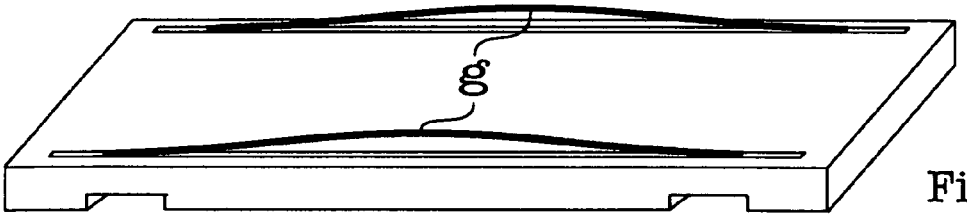
FIG. 21: Example of a substitutive device of the secondary plate, made with two fly springs (g).
Figure 22:
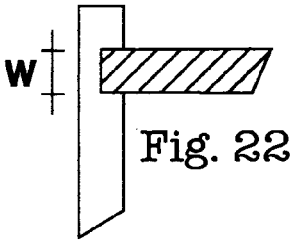
FIGS. 22 and 23: Width of the groove, equal to the thickness of the wall which it has to receive.
Figure 23:
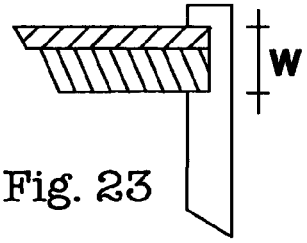
Figure 24:
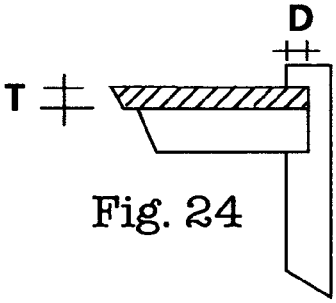
FIG. 24: Depth (D) of the groove, equal to the secondary plate thickness (T).
Figure 25:
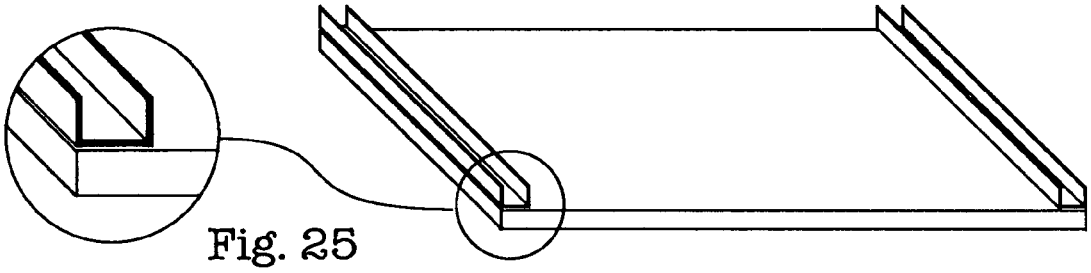
FIG. 25: Example of a substitutive device of the groove.
Figure 26:
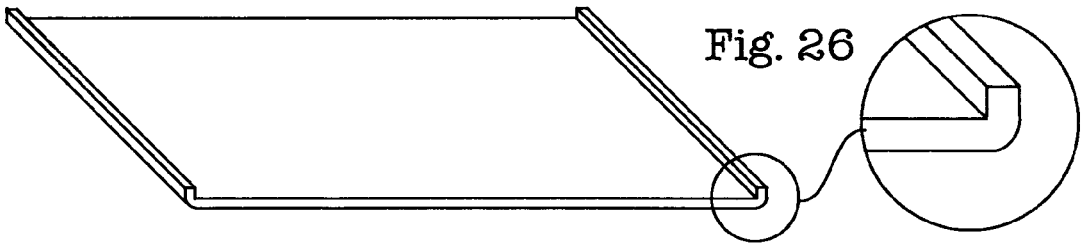
FIG. 26: Primary plate with folds.
Figure 27:
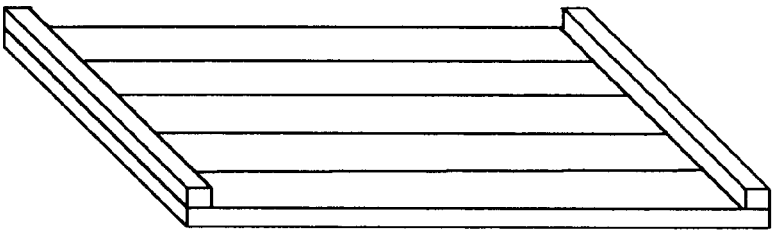
FIG. 27: Prefabricated plate in a folded shape.
Figure 31:
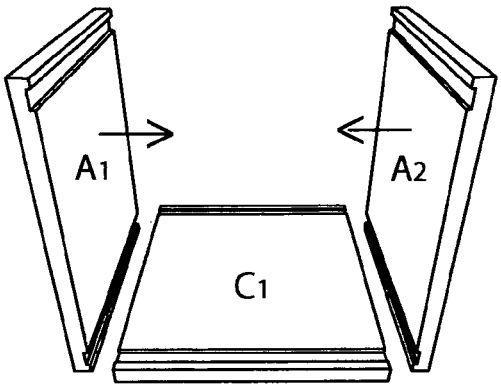
FIG. 31, 32, 33, 34, 35, 36: Procedure of assembling structures.
Figure 32:
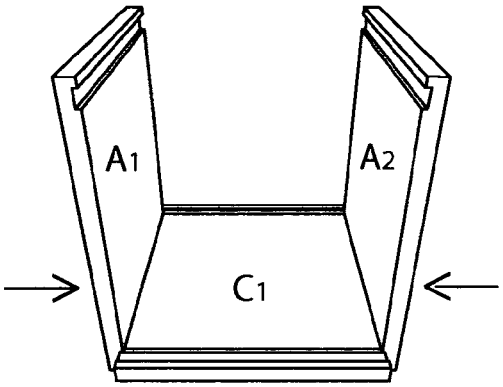
Figure 33:
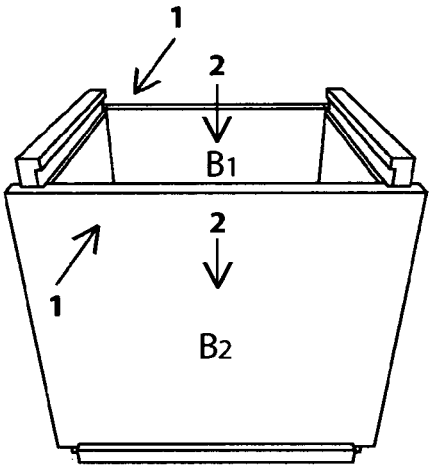
Figure 34:
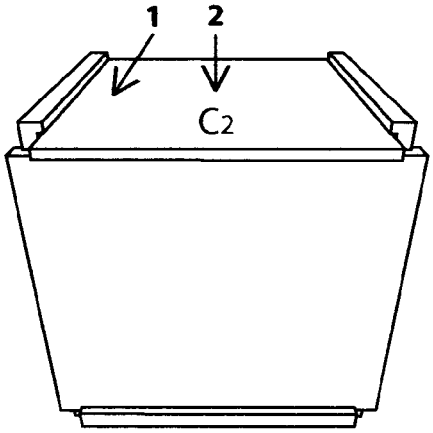
Figure 35:
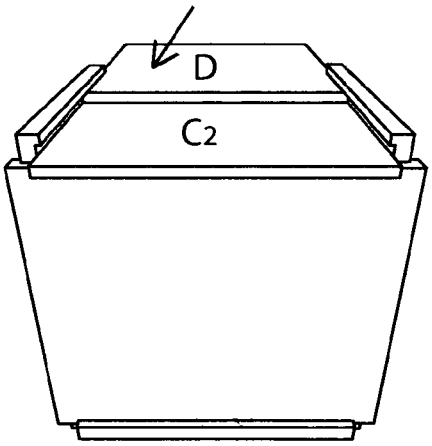
Figure 36:
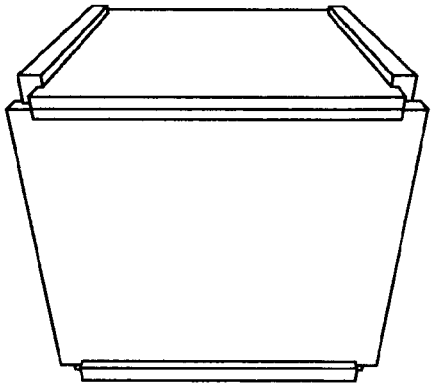

Structures in which the secondary plates are complementary to their primary plates; so all single and multiple walls have an equal thickness and all grooves have an equal width, FIG. 18 (*a,b*).

This solution has an aesthetical character.

Structures wherein the secondary plates are supplementary to their primary plates; so all primary plates have an equal thickness, the multiple walls are thicker than the single walls and the grooves receiving multiple walls are wider than the other ones, FIG. 18 (*c,d*).

This practical solution is suitable for small tables, trolleys, etc., wherein the secondary plate is a glass shelf, FIG. 40.

Figure 37:
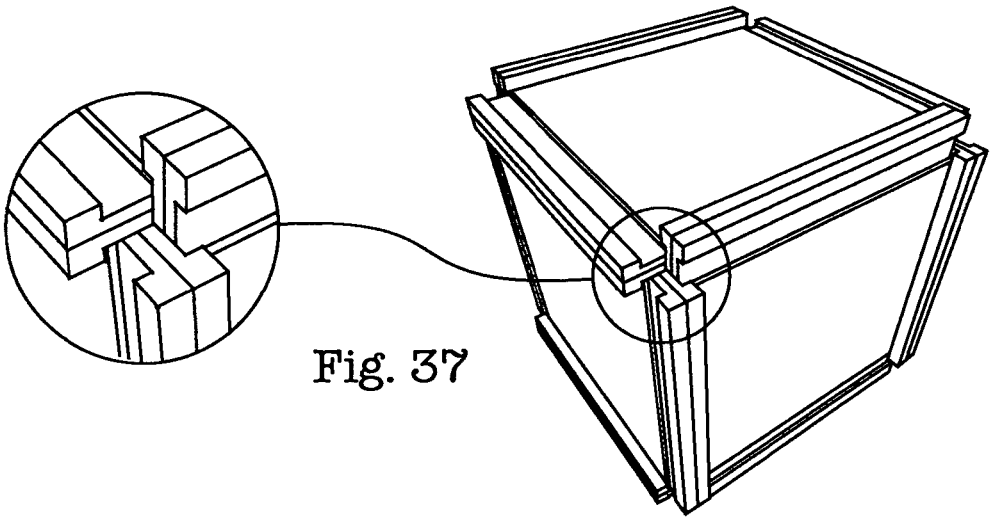
FIG. 37: Cubic structure built up with twelve identical grooved plates.

Cubic structure, built up with twelve perfectly identical grooved plates and coupled pair wise with matching ungrooved faces, FIG. 37.

This configuration is suitable for a witty game.

Figure 38:
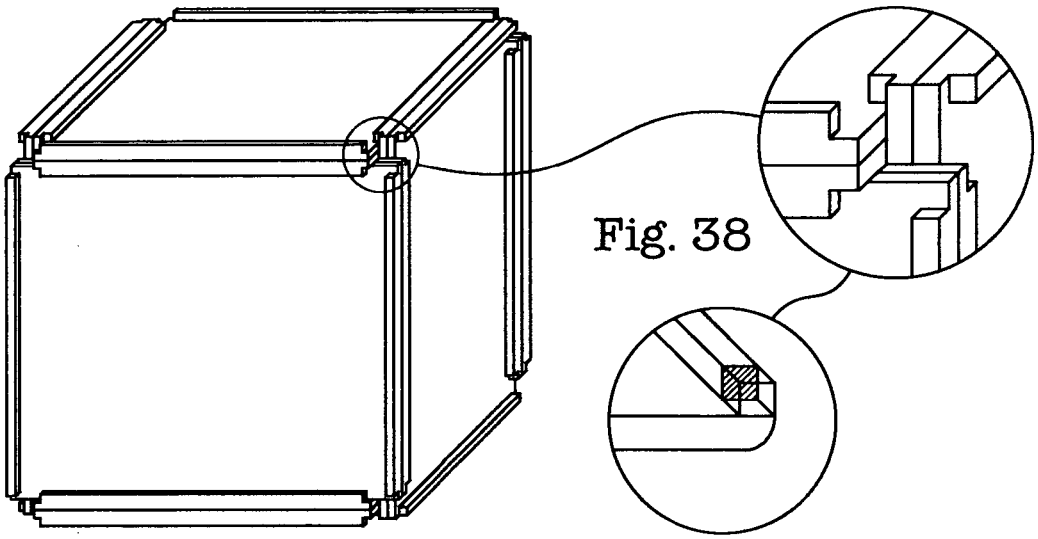
FIG. 38: Cubic structure built up with twelve identical folded plates with folds cut at their edges.

Cubic structure, built up with twelve perfectly identical plates, provided with folds shortened at their edges in measure equal to their depth, coupled pair wise with matching unfolded faces, FIG. 38.

Also this configuration is suitable for a witty game.

Figure 39:
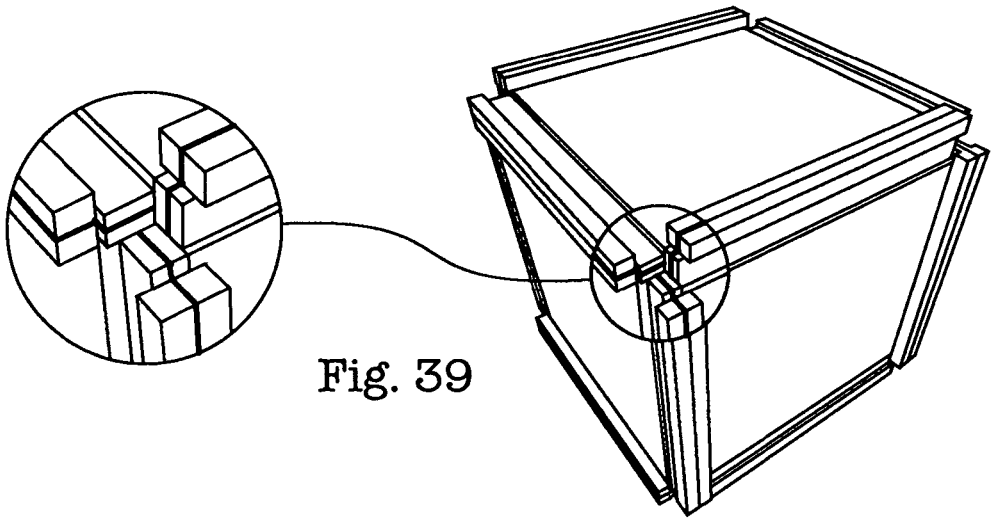
FIG. 39: Stackable structure with pilaster strips cut at their edges.

Stackable structures wherein plates edges are reduced in measure equal to the grooves depth, FIG. 39.

This configuration allows stacking several structures.

Structures containing frame plates, wherein the grooves are jointed also on the internal ribs of plates, and wherein at least two secondary plates are employed, FIG. 41.

This way is suitable for trolleys, showcases, bookshelves, etc.

Structures having a primary plate provided with an access hole and with a secondary plate working as a sliding lid, FIG. 42.

This is a practical solution for boxes.

Structures having an access hole and a blocking lid obtained by the two, one smaller than the other, holing rejected items of the two plates of the multiple wall, FIG. 43.

Also this is a practical solution for boxes.

Multiple walls supplied by a definitively fixing device like a fly spring, FIG. 44, a padlock, FIG. 45, a clip, a screw, etc.

These are useful complements.

Nodal structure wherein walls are extended beyond the shut box part, FIG. 46.

This configuration is suitable making chairs, armchairs, etc.

Multiple nodal structures, composed by many structures joined together by the extension of the primary plates, provided by other couples of grooves, employing several secondary plates, FIG. 47.

This configuration is suitable for building complex structures.

INDUSTRIAL APPLICABILITY

The following list of industrial products that can be built up by the system in object and most part of them are composed with only seven elements simply jointed them together.

Boxes of any types. Cases. Ballot boxes. Witty games. Tanks. Containers. Aquariums. Kennels. Cages. Prefabricated houses. Structures in wood, plastic, metal, glass, concrete, stone. Modular walls. Basements. Platforms. Bookcases. Showcases. Stands. Tables. Small tables. Trolleys. Trunks. Chairs. Pouffes. Benches. Lamps. Closets. Cabinet.

Moreover, if plywood is used, the invention can be carried out employing only a pantograph, which allows to get the finished product In this case it is possible to obtain all plates of the same artefact cutting one piece inside the other from one single sheet of material.

I claim:

1. A joint building system for firmly assembling and securing a box structure, said box structure having six walls and comprising at least seven plates made up of stiff sheet material, wherein said at least seven plates are divided into a first group of primary plates, consisting of six plates, and a second group of secondary plates, comprising at least one plate, each one of said primary plates providing a pair of opposite grooves or folds, at least one of said six walls of said box structure being a multiple wall, said at least one multiple wall being constructed by overlapping one of said six primary plates and said at least one secondary plate by sliding said at least one secondary plate within said grooves or folds of two of said six primary plates different with respect to said one of said six primary plates, said box structure being constructed by first assembling said six primary plates, and then overlapping said at least one secondary plate with said one of said six primary plates, thus constructing said multiple wall, the overlapping of said at least one secondary plate with said one of said six primary plates securing the box structure.

2. A joint building system as claimed in claim 1, wherein stiff said sheet material is selected from one or more of wood, plywood, glass, stone, metal, plastic, as well as any combination of the same.

3. A joint building system as claimed in claim 1, wherein said pairs of opposite grooves or folds of each of said primary plates extend at least partially along the side of the plate.

4. A joint building system as claimed in claim 1, wherein each of said pairs of opposite grooves or folds of each of said primary plates are configured to receive one edge of one of said primary plates, and wherein at least one of said pairs of opposite grooves or folds of each of said primary plates is configured to further receive at least one edge of said at least one secondary plate.

5. A joint building system as claimed in claim 1, wherein said pairs of opposite grooves or folds of each of said primary plates that are configured for receiving multiple walls are wider than said pairs of opposite grooves or folds that are configured for receiving single walls.

6. A joint building system as claimed in claim 1, wherein the width of said grooves or folds of each of said primary plates is equal to the thickness of the wall to be received in said groove or fold.

7. A joint building system as claimed in claim 1, wherein said plates are extended also in the orthogonal direction in respect to said grooves or folds.

8. A joint building system as claimed in claim 1, wherein said plates are internally and/or externally shaped in any of the three dimensions.

* * * * *